United States Patent [19]

Silvestri, Jr.

[11] Patent Number: 4,825,653

[45] Date of Patent: May 2, 1989

[54] WATER COLLECTOR FOR STEAM TURBINE EXHAUST SYSTEM

[75] Inventor: George J. Silvestri, Jr., Winter Park, Fla.

[73] Assignee: Westinghouse Electric Corp., Pittsburgh, Pa.

[21] Appl. No.: 201,223

[22] Filed: Jun. 2, 1988

[51] Int. Cl.[4] ..... F01K 19/00

[52] U.S. Cl. ..... 60/646; 60/657; 60/685; 55/392; 55/461

[58] Field of Search ..... 60/646, 657, 685; 55/392, 394, 461

[56] References Cited

U.S. PATENT DOCUMENTS

| | | | |
|---|---|---|---|
| 4,282,715 | 8/1981 | Edwall et al. | 60/646 |
| 4,527,396 | 7/1985 | Silvestri, Jr. | 60/685 |
| 4,622,819 | 11/1986 | Draper et al. | 60/657 |
| 4,673,426 | 6/1987 | Silvestri, Jr. | 55/457 |

OTHER PUBLICATIONS

P. Von Boeckh, M. Stiefel, U. Frick; "Experience with the Moisture Preseparator (Mops) and with the Special Crossunder Pipe Separator (Scrups) in the Leibstadt Nuclear Plane"; Apr. 14–16, 1986; pp. 1–8.

*Primary Examiner*—Allen M. Ostrager

[57] ABSTRACT

A method and apparatus for collection of water in a steam turbine exhaust system and in particular within a steam turbine exhaust pipe in which there is at least one turn or bend in the pipe and a plurality of substantially parallel turning vanes positioned in the bend for reducing undesirable flow characteristics in steam. The turning vanes extend across the pipe transverse to the direction of steam flow and are attached at opposite ends to a vane support ring embedded in the pipe wall. The invention includes forming a plurality of slots extending through the vane support ring for tranporting water from within the pipe to an external location. The slots are aligned on the vane support ring in an area corresponding to virtually zero pressure differential between each of the vanes and an adjacent vane. The slots preferably extend from a trailing edge of one of the vanes along the line normal to a tangent line to an adjacent vane on the low pressure side of the vane.

4 Claims, 3 Drawing Sheets

WATER COLLECTOR FOR STEAM TURBINE EXHAUST SYSTEM

BACKGROUND OF THE INVENTION

The present invention relates to steam turbines and, more particularly, to a method and apparatus for reducing erosion-corrosion in steam turbine exhaust systems.

Water droplets in steam turbine exhaust systems are known to produce erosion-corrosion. Such erosion arises from the effects of the water droplets impacting and flowing on surfaces within the exhaust system and has been termed flow assisted corrosion. The effect is particularly noticeable in exhaust pipes and is severe beyond bends in such exhaust pipes. Droplet formation at bends is created by turbulence induced in the steam flow as it passes around such bends. This droplet formation phenomena is well known and various efforts have been made to reduce the amount of droplet formation which occurs at such bends. One typical solution to the problem of droplet formation is to incorporate turning vane assemblies in the bends to separate the steam flow into a plurality of channels and to reduce the strength of vortices thus limiting the turbulence and minimizing the creation of such droplets. The turning vane assemblies essentially reduce the development of undesirable flow characteristics in a high velocity fluid stream. However, the turning vanes create an additional problem in that water droplets in the steam tend to collect on the vanes and along the walls of the bend and then re-enter the flow as considerably larger and therefore more erosive droplets.

Various proposals have been submitted in an effort to alleviate the erosion-corrosion problem created by water droplets in steam. In general, it is known to incorporate water collection devices into steam exhaust pipes to attempt to attract the water droplets and remove them from the steam flow. A disadvantage of water collection devices associated with the high velocity exhaust steam flow is that such devices must not adversely affect the flow characteristics and must be physically capable of collecting most of the water in their immediate vicinity. The device must also be positioned at a point that provides access to as much of the water as possible. At least some water collectors have been positioned on the suction side or downstream side of the turning vanes themselves in order to attempt to collect the water which forms on the turning vanes. However, such positioning on the turning vanes does not always resolve the problem of positioning the collector at a point where the water tends to accumulate. Additionally, the collectors physical capability of collecting the water is adversely affected by pressure differentials in the vicinity of the collector. The pressure differentials across the surface of a turning vane may vary significantly from the leading edge to a trailing edge. In some designs it has been noted that a portion of the collecting surface may be at a higher pressure than another portion of the collecting surface resulting in water entering the high pressure part and being expelled out of the low pressure part without being collected.

SUMMARY OF THE INVENTION

It is an object of the present invention to provide a method and apparatus which overcomes the above mentioned disadvantages of water collection systems in steam turbines.

It is another object of the present invention to provide a method and apparatus for collecting water in exhaust pipes of steam turbines in which the method and apparatus does not adversely affect the flow characteristics of steam in the exhaust pipe.

It is still another object of the present invention to provide a water collection system in a steam turbine exhaust system which is physically capable of collecting the majority of the water in the immediate vicinity of the collector.

It is a further object of the present invention to provide a method and apparatus for collecting water in a steam turbine at a point which provides access to a large portion of the water generated in the exhaust system.

The above and other objects are attained in a steam turbine exhaust system in which the system includes an exhaust pipe having at least one bend and a plurality of substantially parallel turning vanes positioned in the bend for reducing undesirable flow characteristics. The turning vanes in the illustrative embodiment extend across the exhaust pipe transverse to the direction of steam flow and are attached at opposite ends to a vane support ring embedded in the pipe wall. In the preferred method, a plurality of slots are formed through the vane support ring for transporting water from within the pipe to an external location, the slots being aligned on the vane support ring in an area corresponding to virtually zero pressure differential between each of the vanes and an adjacent vane. The method also includes the step of forming the plurality of slots with each of the slots being oriented to extend from a trailing edge of each of the vanes to an inner section of an adjacent vane normal to a tangent line of the adjacent vane.

DESCRIPTION OF THE DRAWINGS

For a better understanding of the present invention, reference may be had to the following detailed description taken in conjunction with the accompanying drawings in which.

DETAILED DESCRIPTION OF THE PREFERRED EMBODIMENT

Figure 1:
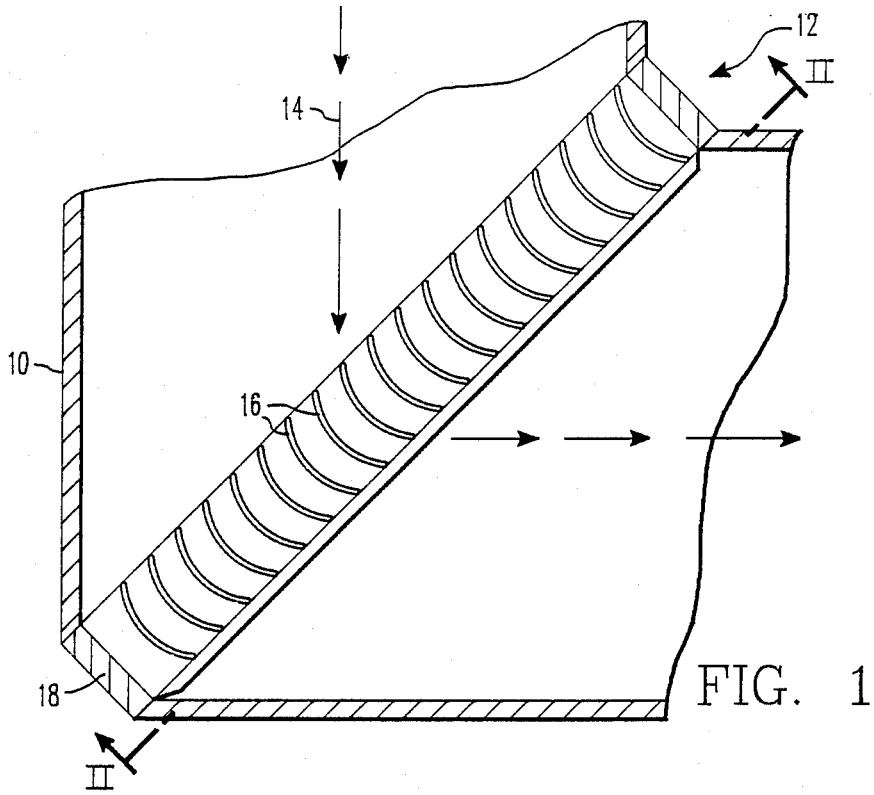
FIG. 1 is a cross-sectional view through a bend in a steam turbine exhaust pipe showing a plurality of turning vanes positioned in the bend so as to redirect steam flow around the bend.

Turning first to FIG. 1, there is shown a top cross-sectional view of a bend in a steam turbine exhaust pipe 10. The bend, indicated generally at 12, causes the steam indicated by the lines 14 to turn through a 90° angle. Within the bend 12, there is provided a plurality of turning vanes 16 which aid in reducing the development of undesirable flow characteristics of the steam. In particular, the vanes help to prevent turbulence and vortex generation at the bend. As previously mentioned, however, the turning vanes produce an added complication in that water droplets in the steam tend to collect on the vanes and the walls of the bend or elbow and then reenter the flow as considerably larger and therefore more erosive droplets. Nevertheless, such vanes do assist in reducing turbulence and the formation of water droplets in the steam flow. The vanes are normally mounted within a ring indicated at 18 which can be inserted in the steam exhaust pipe at desired locations. depending upon the degree of bend, the vane ring 18 may have different configurations to accommodate the bend.

Figure 2:
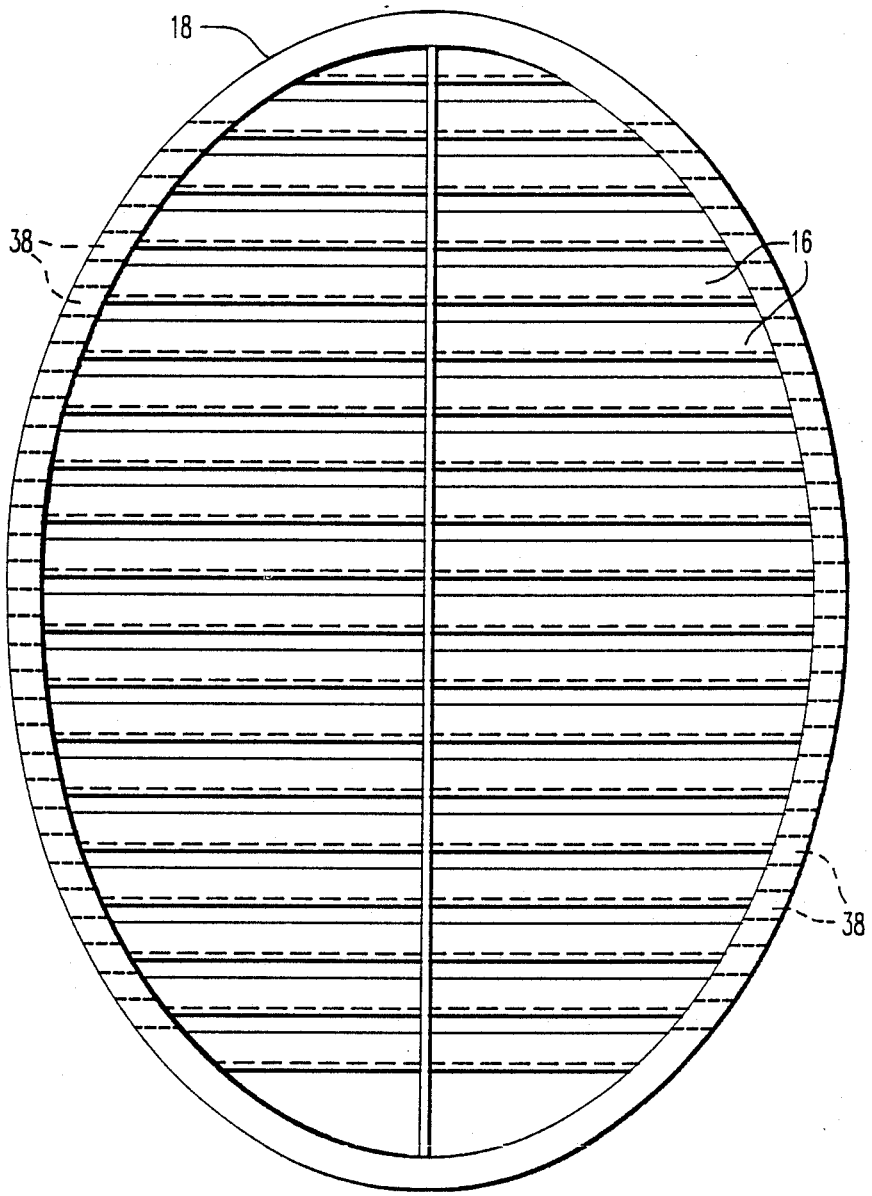
FIG. 2 is a view taken along the lines 2—2 of FIG. 1.

FIG. 2 illustrates a cross-sectional view taken through the turning vane assembly of FIG. 1 along the lines 2—2 and illustrates a turning vane assembly suitable for use in a 90° bend. It will be noted that the vane assembly for such a bend assumes an oval shape. The vane ring is clearly shown in this view as element 18 and the vanes are illustrated as elements 16. A stiffening bar 17 extends centrally of the vanes 16 to reduce vibration.

Figure 4:
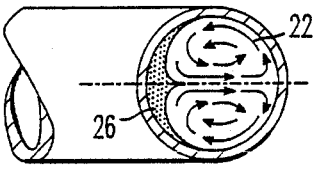
FIG. 4 is a cross-sectional view of a bend in a cylindrical pipe illustrating the secondary flow characteristics of a fluid in the pipe.

Before describing the present method and apparatus for collection of water in turbine exhaust systems, reference is now made to FIG. 4 in which there is shown a cross-sectional view taken through a steam exhaust pipe 20 transverse to a direction of flow of the steam. The pipe 20 includes a bend 22 which brings the pipe out of the plane of the paper. Although the primary flow is in the direction of the pipe, there is a secondary flow transverse to the direction of the primary flow as illustrated by the arrows 24. Such secondary flow possesses components at right angles to the axis of the fluid channel with the components taking the form of diffuse vortices with axis parallel to the main flow. In curved pipes or channels, secondary flow has a motion outwards near the flow center and inwards near the walls. The characteristics of the secondary flow cause water droplets accumulating in the primary flow to be directed towards the inner radius of a bend as illustrated by the darkened area 26 in FIG. 4. The water built-up pattern 26 illustrated in FIG. 4 is characteristic of a high velocity flow. As the flow velocity decreases, the effects of gravity come into play and cause the water accumulation indicated at 26 to shift to the lower vertical position in the pipe. In practice, steam flows in a steam exhaust pipe are generally sufficient that the effects of gravity are negligible. Thus, most of the water accumulating in a steam exhaust pipe will be found positioned on the inside of the bend.

Figure 3:
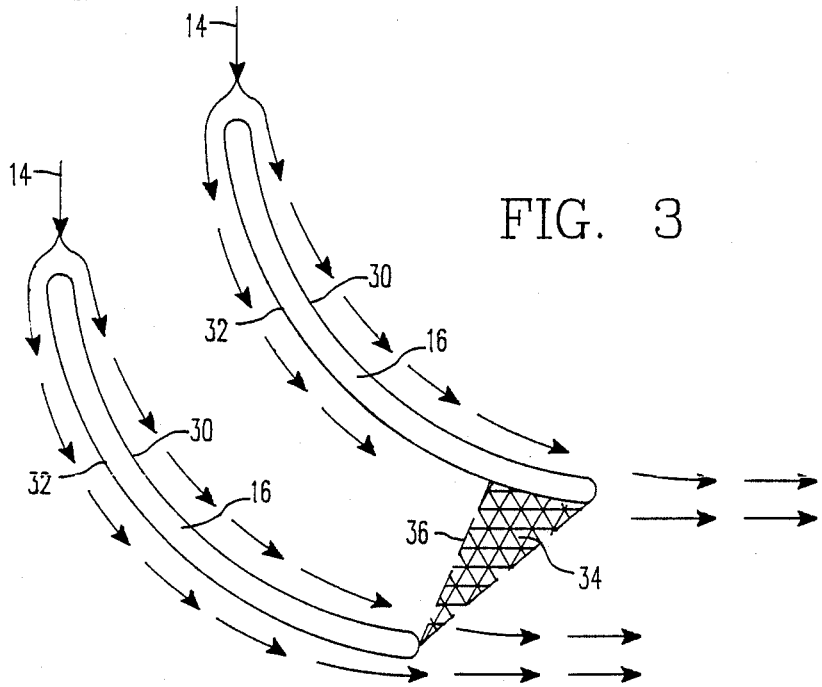
FIG. 3 is a cross-sectional illustration of a pair of turning vanes showing the steam flow and an area of substantially constant pressure adjacent the trailing edges of the turning vanes.

Secondary flow effects are not eliminated by the addition of turning vanes in the bend radius but are modified or broken up by the vanes so that the water tends to accumulate on the vane surfaces. The secondary flow characteristics causes the water accumulating on the vanes to be transported radially along the pressure surface of the vane from where it flows across the end wall to the suction surface of the vane. The pressure surface is normally the inner turning surface while the suction surface is the outer radial surface of the vane. By reference to FIG. 3, it can be seen that each turning vane 16 includes a high pressure or pressure surface side 30 and a low pressure or suction side 32. Because of the turning of the flow, the pressure on side 30 is higher than the pressure on side 32 within the confines of the channel between sides 30 and 32 of adjacent vanes except at the wedge shaped section 34 at the exit.

Applicants have found that there is a relatively lare portion of virtually zero pressure differential at the trailing edge of the turning vanes 16. This zero pressure differential area is indicated at 34 and generally comprises a triangular shaped area extending from the low pressure side of one of the vanes to the tip of the trailing edge of an adjacent vane. In general, the area is defined by a line extending from a trailing edge of one vane to a low pressure side of an adjacent vane such that the line is normal to a tangent line of the adjacent vane. The line is indicated at 36 in FIG. 3. The triangle shaped area 34 is further defined by a line extending from trailing edge to trailing edge of adjacent vanes. The advantage of having found virtually zero pressure differential area along a trailing edge of the turning vanes is that this area provides a collection area where the flow concentrates and is also in an area of low pressure differential. The secondary flow characteristics can be utilized in conjunction with the low pressure area 34 to provide a method and apparatus for collecting water which accumulates at bends in the steam exhaust pipe. In particular, it may be noted in FIG. 2 that there are provided a plurality of slots 38 extending through the wall of the vane ring 18 to external of the exhaust pipe 10. The slots 38 are aligned with the areas 34 at the end of the turning vanes. Since the secondary flow characteristics tend to cause the water droplets to circulate around the turning vanes and to accumulate at the ends of such vanes in the lowest pressure area, the slots can be aligned so as to maximize the collection of water droplets.

Figure 5:
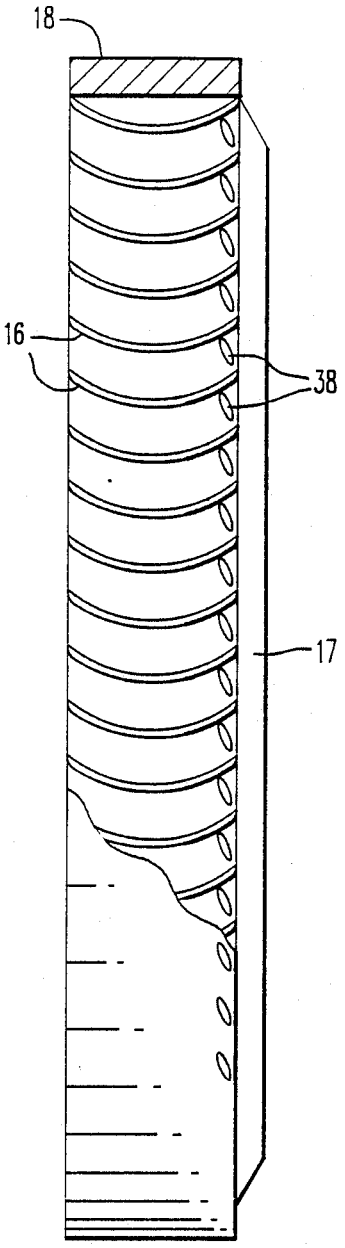
FIG. 5 is a partial cross-sectional view of a vane ring illustrating the placement of the plurality of slots for water collection in accordance with the present invention.

The location of the slots 38 can be seen in better detail in FIG. 5 which shows a section of the vane ring 18 taken along the line 5—5 of FIG. 2. The slots can be seen extending through the wall of vane ring 18 and oriented so as to be substantially aligned with the line 36 of FIG. 3. While their position can be somewhat changed, it is critical that the slots fall within the area designated by 34 in FIG. 3. In this location, the virtually zero pressure differential allows the water to flow out of the slots without being blown back into the steam flow path. Furthermore, the secondary flow characteristics cause the water to accumulate at the location of the slots and thus assure that the maximum amount of water is expelled through the slots. Since the pressure outside the vane ring can be made somewhat lower than the pressure within the exhaust pipe, the water can be directed out of the exhaust pipe through the collection slots 38.

The present invention achieves the desired results of providing superior water collection and reducing erosion in steam exhaust systems without introduction of additional water droplets into the steam flow. It is believed that prior art systems fail to move significant amounts of water even though they tended to reduce the amount of erosion simply from the effect of regurgitating the water into the steam flow in a fine spray of droplets smaller than those that would be present without the collector. The present invention avoids regurgitating the water back in the steam flow and actually removes a significant amount of water from the system. The prior art systems of water collection failed to recognize the dynamics of steam flow and did not discover that the water accumulation at the trailing edge of the turning vanes could be removed by the formation of slots in the vane ring at areas of virtually zero pressure differential.

While the invention has been described in what is presently considered to be a preferred embodiment, other modifications and variations will become apparent to those having ordinary skill in the art. Accordingly, it is intended that the invention be interpreted within the scope of the appended claims.

What is claimed is:

1. A method for collection of water in a steam turbine exhaust pipe, the exhaust pipe including at least one bend and a plurality of substantially parallel turning vanes positioned in the bend for reducing undesirable flow characteristics, the turning vanes extending across the pipe transverse to the direction of steam flow and being attached at opposite ends thereof to a vane support ring embedded in the pipe wall, the method comprising forming a plurality of slots extending through the vane support ring for transporting water from within the pipe to an external location, the slots being aligned on the vane support ring in an area corresponding to virtually zero pressure differential between each of the vanes and an adjacent vane.

2. The method of claim 1 wherein the step of forming a plurality of slots includes the step of orienting the slots along a line extending from a trailing edge of each of the vanes to an intersection of an adjacent vane normal to a tangent line of the adjacent vane.

3. A water collection system in a steam turbine exhaust pipe comprising:

an exhaust pipe having at least one bend;

a plurality of vanes positioned in the exhaust pipe at the at least one bend and oriented for directing steam flow through the bend, said vanes extending across said pipe and being attached at opposite ends thereof to a wall of the pipe; and a plurality of slots formed in the pipe wall adjacent the ends of the vanes, the slots extending between adjacent ones of the vanes through areas of substantially zero pressure differential.

4. The system of claim 3 wherein each of said slots extend from a trailing edge of a corresponding one of the vanes to an adjacent vane so as to intersect said adjacent vane normal to a tangent line of said adjacent vanes.

* * * * *